United States Patent [19]

Junkers

[11] Patent Number: 4,916,986

[45] Date of Patent: Apr. 17, 1990

[54] FLUID OPERATED WRENCH

[76] Inventor: John K. Junkers, 7 Arrowhead La., Saddle River, N.J. 07458

[21] Appl. No.: 196,384

[22] Filed: May 19, 1988

[51] Int. Cl.[4] ..... B25B 13/00

[52] U.S. Cl. ..... 81/57.39; 81/112

[58] Field of Search ..... 81/57.39, 57.44, 111, 81/112, 117

[56] References Cited

U.S. PATENT DOCUMENTS

| | | | |
|---|---|---|---|
| 1,131,136 | 3/1915 | Huffman | 81/117 |
| 4,446,762 | 5/1984 | Junkers | 81/57.39 |
| 4,584,913 | 4/1986 | Logan | 81/111 X |

FOREIGN PATENT DOCUMENTS

| | | | |
|---|---|---|---|
| 2130513 | 6/1984 | United Kingdom | 81/57.39 |

*Primary Examiner*—James G. Smith

*Attorney, Agent, or Firm*—Michael J. Striker

[57] ABSTRACT

A fluid operated wrench for tightening or loosening threaded connectors comprises a drive unit performing a forward and a rearward stroke, an abutment element arranged to abut against a neighboring object, and an engaging element arranged to engage and turn a threaded connector, the drive unit, the abutment element and the engaging element being connected with one another so that when the drive unit performs the forward stroke and the abutment element abuts against a neighboring object, the engaging element turns a threaded connector and at the same time a reaction force produced during the forward stroke pushes the engaging element onto the threaded connector.

1 Claim, 2 Drawing Sheets

FLUID OPERATED WRENCH

BACKGROUND OF THE INVENTION

The present invention relates to a fluid operated wrench which is used for tightening or loosening threaded connectors such as nuts, bolts and the like. It especially relates to a fluid operated wrench which has an open type engaging element for engaging a threaded connector. The fluid operated wrenches with open type engaging elements are used generally in the event when a space for introducing an engaging element is very narrow, and a closed type engaging element cannot be placed onto a threaded connector.

A certain problem with the open type engaging element is that a reaction force which is produced during tightening or loosening and especially during a forward stroke tends to pull the engaging element off a threaded connector. Thus, there is the danger of undesirable disengagement of the wrench from a threaded connector to be tighteneing or loosened.

SUMMARY OF THE INVENTION

Accordingly, it is an object of the present invention to provide a fluid operated wrench which avoids the disadvantages of the prior art.

In keeping with these objects and with others which will become apparent hereinafter, one feature of the present invention resides, briefly stated, in a fluid operated wrench with drive means, an abutment element abutting against a neighboring object, and an engaging element arranged to engage and turn a threaded connector, wherein the drive means, the abutment element and the engaging element are connected with one another so that when the abutment element abuts against a neighboring object and the drive means perform a forward stroke, the engaging element turns a threaded connector and at the same time a reaction force which is produced in the forward stroke acts on the engaging element so as to push it onto the threaded connector.

When the fluid operated wrench is designed in accordance with the present invention, a disengagement of the engaging member from a threaded connector during operation cannot occur.

In accordance with another feature of the present invention, the connecting means for connecting the abovementioned elements include at least one plate which has two opposite ends, wherein one of the ends is pivotally connected to the engaging element, the other of the ends is pivotally connected to the abutment element, and the plate is turnable about a pivot point located between the opposite ends, for example pivotally attached to the drive means.

In accordance with still a further feature of the present invention, the engaging element can include at least two engaging members which are arranged to surround a threaded connector at its opposite sides and connected with one another movably between a fixed position in which they fixedly engage a threaded connector and a released position in which at least one engaging member is released from a threaded connector.

The piston rod of the drive means can be connected to the connecting plate and the abutment element so that when the piston rod is displaced for performing the forward stroke it displaces the plate so that one of the engaging members moves relative the other engaging member and at the same time the engaging element as a whole is driven to turn a threaded connector.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
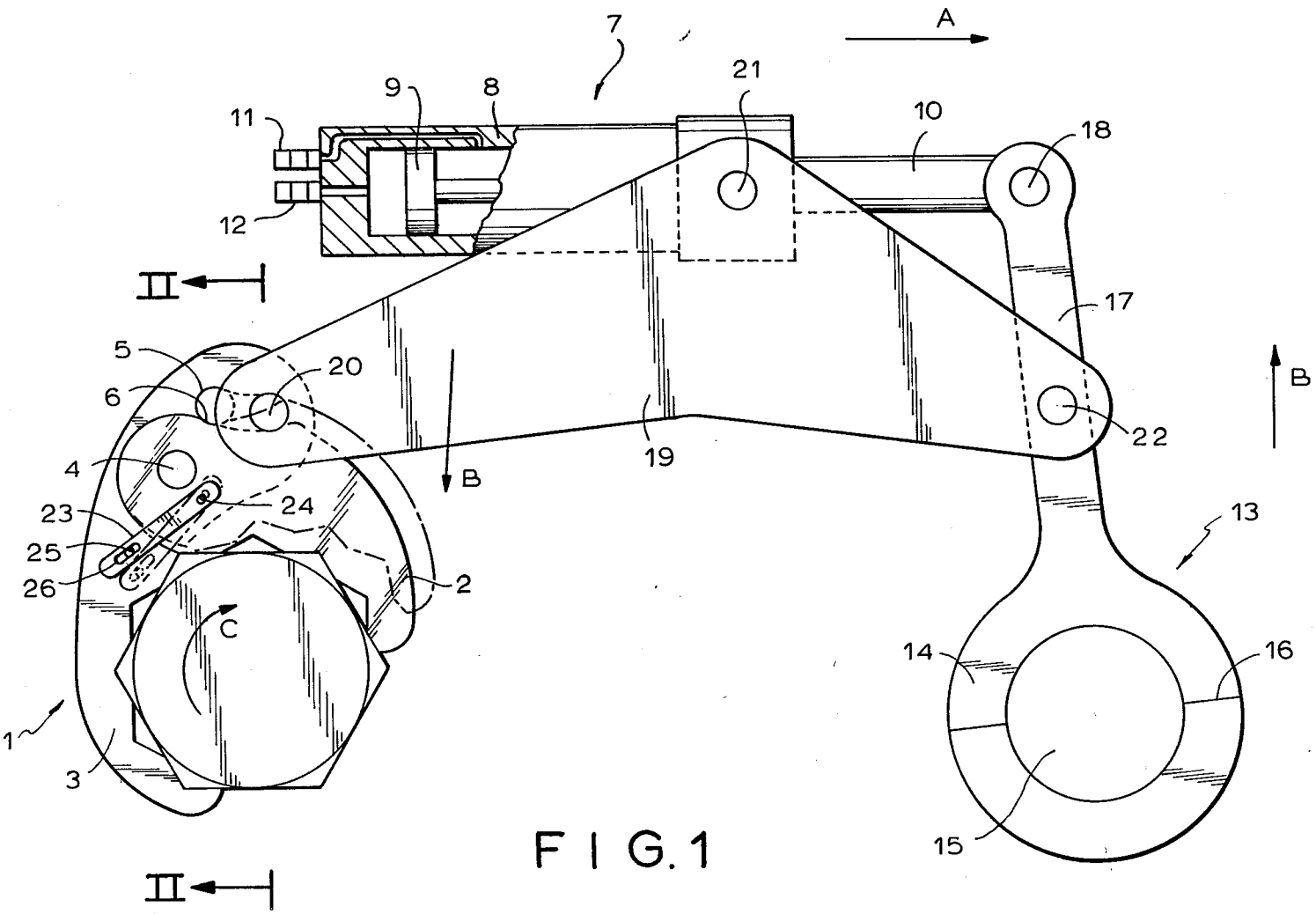
FIG. 1 is a side view of the fluid operated wrench in accordance with the present invention.
Figure 2:
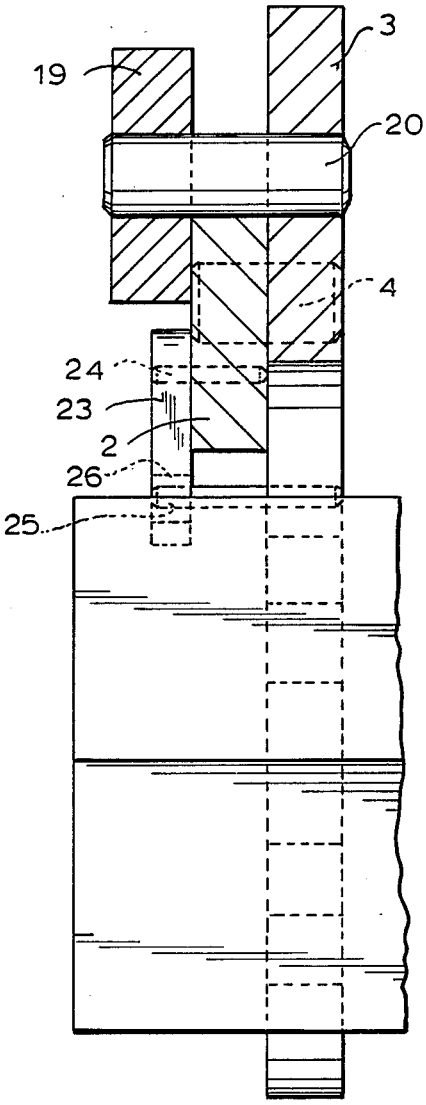
FIG. 2 is a view showing a section taken along the line II—II in FIG. 1.

A fluid operated wrench in accordance with the present invention has an engaging element which is identified with reference numeral 1 and arranged to be placed on a threaded connector to be tightened or loosened. The engaging element 1 is of an open type so that it does not peripherally completely surround the threaded connector. The engaging element 1 includes two jaw-like engaging members 2 and 3 each formed to embrace and engage a portion of the periphery of a threaded connector. The engaging members 2 and 3 are pivotally connected with one another by a pivot pin 4.

The engaging member 2 has a guiding surface which is identified with reference numeral 5. The engaging member 3 has an elongated opening which is identified with reference numeral 6. The guiding surface 5 of the engaging member 2 and the elongated opening 6 of the engaging member 3 have a substantially curved contour.

The fluid operated wrench of the invention has drive means including a cylinder-piston unit identified with reference numeral 7. The cylinder-piston unit has a cylinder 8 provided with an inner chamber, a piston 9 reciprocably guided in the cylinder 8, and a piston rod 10 connected with the piston 9 and having a free end extending outwardly beyond the cylinder 8. Working fluid passages 11 and 12 are connected with respective sides of the piston 9.

An abutment element is identified with reference numeral 13 and serves for abutting the fluid operated wrench against a neighboring object, for example a neighboring nut, bolt or the like. The abutment element has an abutment member 14 with an inner opening 15 to be placed on a neighboring object. The abutment member 14 has a detachable lower portion which is connected with the remaining portion over a separation line 16 by known means of, for example, screws or the like. The abutment element 13 also has an extension rod 17 which can be formed of one-piece with the abutment member 14 and connects the latter with the free end of the piston rod 10 of the drive means 7. The connection is performed in a pivotal manner, for example by a pivot pin 18. The fluid operated wrench of the invention further has at least one plate 19. Also, two such plates can provided at opposite sides of the wrench. The plate 19 is substantially triangular and has an apex pivotally connected with the cylinder-piston unit 7 for example by a pivot pin 21, one end pivotally connected with the engaging element 1 for example by a pin 20, and another end pivotally connected with the abutment member 13, for example by a pivot pin 22.

As can be seen from the drawings, the engaging members 2 and 4 are pivotable relative to one another in a fixed position and in a released position. The fixed position is shown in solid lines. When the pivot pin 20 is displaced to the right end of the elongated opening 6 in the engaging member 3 being guided over the guiding surface 5 of the engaging member 2, the engaging members 2 and 3 fixedly clamp the threaded connector, for example a nut, by their engaging formations which include alternatingly arranged projections and grooves. When the pin 20 is displaced to the left end of the elongated opening 6 of the engaging member 3 while being guided over the guiding surface 5 of the engaging member 2 in an opposite direction, the engaging member 2 can be released from the threaded connector as shown in broken lines in the drawings.

The fluid operated wrench in accordance with the present invention operates in the following manner:

For tightening or loosening a threaded connector for example a nut shown at the left side of the drawings, the abutment element 13 is placed on a neighboring object, for example a neighboring nut, and the engaging element 1 in its released position is placed on the nut to be tightened or loosened. The cylinder-piston unit is activated, the piston is displaced to the right, and the piston rod 10 is extended from the cylinder 8 to the right in the drawing in direction of the arrow A to perform a forward stroke. Since the abutment element 13 is arranged on the neighboring nut, the movement of the piston rod is transmitted through the abutment element 13 to the plate 19 and the left end of the plate 19 turns. The pin 20 is displaced and moves to the end of the elongated opening 6 in the engaging member 3, while being guided on the guiding surface 5 of the engaging member 2, to finally urge the engaging element 1 to the fixed position in which it fixedly clamps the nut to be tightened or loosened. During further extension of the piston rod 10 the respective transmission of its movement through the plate 19, the engaging element 1 is turned and thereby turns the nut. In accordance with the present invention the reaction force E which is produced during the forward stroke of the piston for turning the nut acts so that it pushes the engaging element 1 onto the nut. Therefore, a disengagement of the engaging element from the nut cannot occur.

It will be understood that each of the elements described above, or two or more together, may also find a useful application in other types of constructions differing from the types described above.

While the invention has been illustrated and described as embodied in a fluid operated wrench, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A fluid operated wrench for tightening or loosening threaded connectors, comprising drive means performing a forward and a rearward stroke; an abutment element arranged to abut against a neighboring object; an engaging element arranged to engage and turn a threaded connector, said drive means, said abutment element and said engaging element being connected with one another so that when said drive means performs said forward stroke and said abutment element abuts against a neighboring object, said engaging element turns a threaded connector and at the same time a reaction force produced during said forward stroke pushes said engaging element onto the threaded connector, said engaging element including two engaging members which are arranged to surround a threaded connector at its opposite sides and connected with one another movably between a fixed position in which said engaging members fixedly engage a threaded connector for tightening and loosening the same, and a released position in which at least one of said engaging members is released from the threaded connector; and an elongated opening formed in one of said engaging members of said engaging element, a guiding surface formed in the other of said engaging members of said engaging element, a pin displaceable by said drive means in said elongated opening of said one engaging member while being guided on said guiding surface of said other engaging member, said elongated opening of said one engaging member and said guiding surface of said other engaging member having a substantially curved contour.

* * * * *